United States Patent [19]

Imaoka et al.

[11] 4,413,498

[45] Nov. 8, 1983

[54] ROTARY TRANSFER PRESS

[75] Inventors: Hiroshi Imaoka; Michio Sakiyama, both of Nara; Masahiro Yamamoto, Sakai, all of Japan

[73] Assignee: Hitachi Shipbuilding & Engineering Company Limited, Osaka, Japan

[21] Appl. No.: 347,101

[22] Filed: Feb. 9, 1982

[30] Foreign Application Priority Data

Feb. 24, 1981 [JP] Japan ..... 56-24601
Jul. 20, 1981 [JP] Japan ..... 56-108455[U]
Sep. 25, 1981 [JP] Japan ..... 56-142971[U]

[51] Int. Cl.[3] ..... B21J 11/00

[52] U.S. Cl. ..... 72/405; 72/404; 72/450; 72/417; 72/421; 100/207; 414/744 R

[58] Field of Search ..... 72/405, 450, 448, 455, 72/456, 417, 421; 100/207; 414/225, 226, 744 A, 744 R

[56] References Cited

U.S. PATENT DOCUMENTS 2,831,423 4/1958 Hautau .
3,289,450 12/1966 Clements ..... 72/456

FOREIGN PATENT DOCUMENTS 2051637 6/1980 United Kingdom ..... 100/207

*Primary Examiner*—Francis S. Husar
*Assistant Examiner*—David B. Jones
*Attorney, Agent, or Firm*—Joseph W. Farley

[57] ABSTRACT

A rotary transfer press comprising a bed; an upright extending upward from the bed; a crown mounted on the upright and providing a plurality of stations between the crown and the bed in an annular arrangement; a slide upwardly and downwardly movable by being guided by the upright; a feed bar having clamps corresponding in number to the number of the stations and provided around the upright for transferring workpieces from station to station in succession; a slide drive disposed in the crown for moving the slide upward and downward and comprising a main shaft coupled to a main electric motor to rotate at a reduced speed, eccentric rings coupled to the main shaft to rotate at a reduced speed and connecting rods connecting the eccentric rings to the slide; a feed bar lifting drive having a lift cam coupled to one of the eccentric rings and adapted to be actuated by the lift cam for moving the feed bar upward and downward; a feed bar feeding-drive having a feed cam coupled to one of the eccentric rings and adapted to be actuated by the feed cam; and a clamp drive having a clamp cam coupled to one of the eccentric rings and adapted to be actuated by the clamp cam for operating the clamps. Since the feeding movement and upward and downward movement of the feed bar and the operation of the clamps are mechanically related to the movement of the slide, press work can be conducted stably even at a high speed.

7 Claims, 21 Drawing Figures

ROTARY TRANSFER PRESS

The present invention relates to a rotary transfer press, and more particularly to a rotary transfer press which comprises a plurality of stations in an annular arrangement and in which workpieces are transferred from station to station in succession for working.

GB Pat. No. 841,007 discloses a rotary transfer press comprising a bed, an upright extending upward from the bed, a crown mounted on the upright and providing a plurality of stations between the crown and the bed in an annular arrangement, a slide upwardly and downwardly movable by being guided by the upright, and a feed bar having clamping means corresponding in number to the number of the stations and provided around the upright for transferring workpieces from station to station in succession. While the slide is driven upward and downward by eccentric rings which are rotated by a main electric motor through reduction gear means and rods connecting the eccentric rings to the slide, hydraulic cylinders which are not coupled to the motor mechanically are used individually for driving the feed bar for feeding and vertically moving and opening or closing the clamping means, so that the transfer press requires control means for operatively connecting the movable parts and is costly due to the provision of a multiplicity of hydraulic cylinders. Further even if it is attempted to couple the hydraulic cylinders to one another and to the main motor, there are limitations which impose great restrictions on the transfer of workpieces for working, making it impossible to increase the speed of pressing operation. Moreover, such an attempt requires a complex piping system for the working fluid of the hydraulic cylinders to render the press complicated in construction.

The object of the present invention is to provide a rotary transfer press which is similar to the above press in general construction and in which the slide is driven in mechanically coupled relation to the drive of the feed bar and clamping means, and the reduction means for driving the feed bar and clamping means is also used as the reduction means for driving the slide, whereby the press is made inexpensive, compact in construction, stable in operation and suited to a high-speed operation.

To fulfill this object, the present invention provides a rotary transfer press comprising a bed; an upright extending upward from the bed; a crown mounted on the upright and providing a plurality of stations between the crown and the bed in an annular arrangement; a slide upwardly and downwardly movable by being guided by the upright; a feed bar having clamping means corresponding in number to the number of the stations and provided around the upright for transferring workpieces from station to station in succession; slide drive means disposed in the crown for moving the slide upward and downward and comprising a main shaft coupled to a main electric motor to rotate at a reduced speed, eccentric rings coupled to the main shaft to rotate at a reduced speed and connecting rods connecting the eccentric rings to the slide; feed bar lifting drive means having a lift cam coupled to one of the eccentric rings and to be actuated by the lift cam for moving the feed bar upward and downward; feed bar driving means having a feed cam coupled to one of the eccentric rings and to be actuated by the feed cam for feeding; and clamp drive means having a clamp cam coupled to one of the eccentric rings and to be actuated by the clamp cam for operating the clamping means.

The features and advantages of the invention will become apparent in detail from the following description of embodiments given with reference to the accompanying drawings, in which.

Throughout the drawings, functionally like parts are referred to by like reference numerals.

Figure 1:
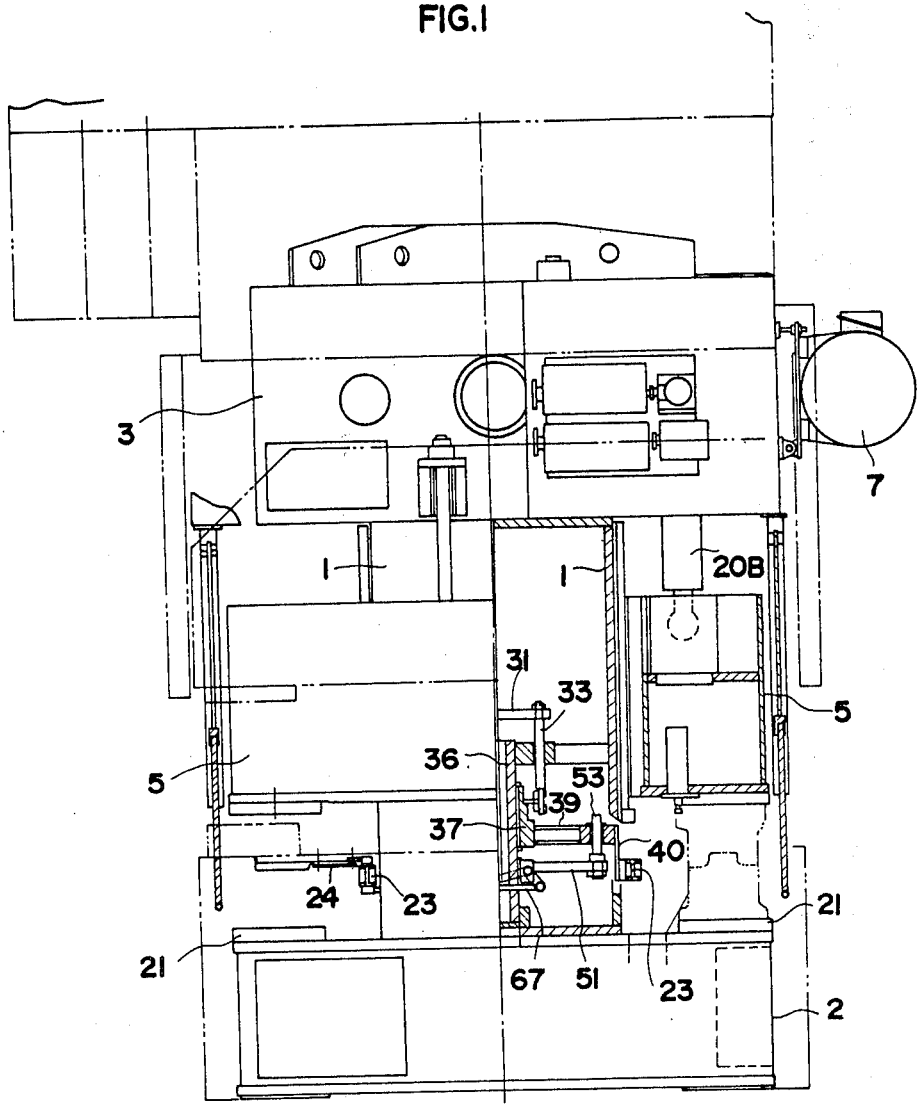
FIG. 1 is a front view partly broken away and showing a rotary transfer press of this invention in its entirety.
Figure 2:
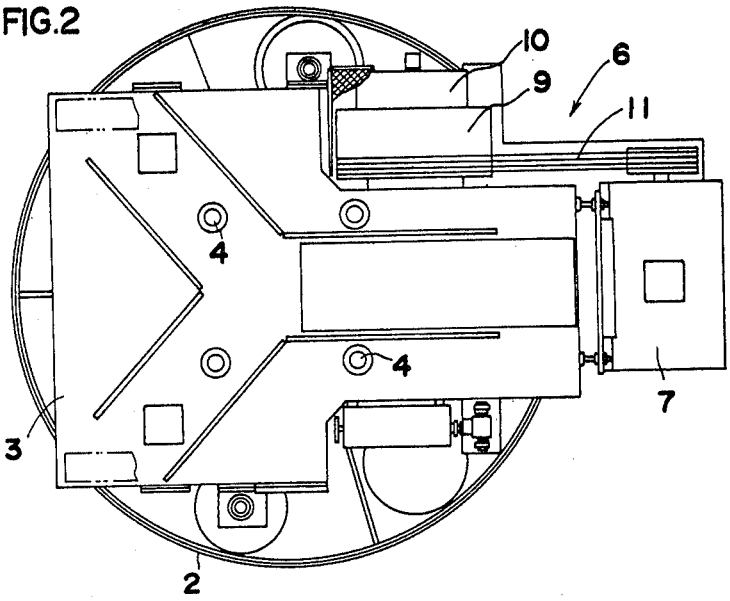
FIG. 2 is a top view of the same.
Figure 3:
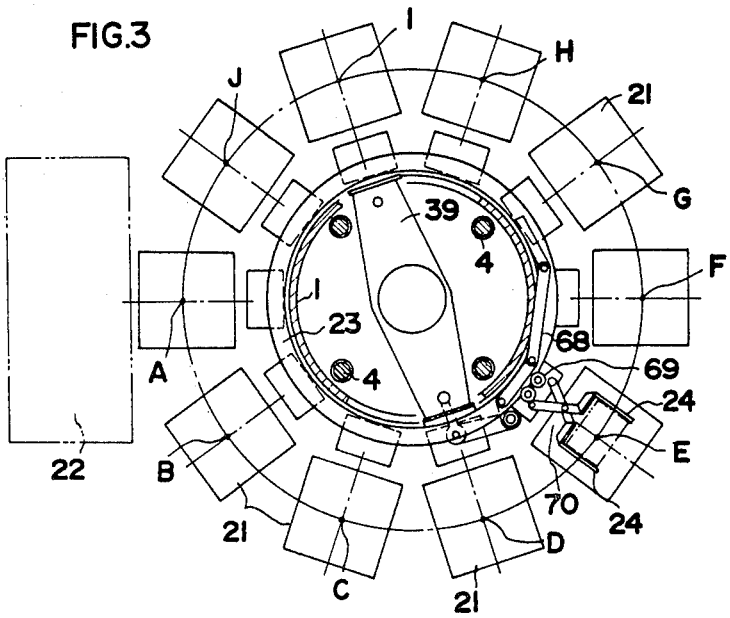
FIG. 3 is a plan view in cross section showing the same.
Figure 4:
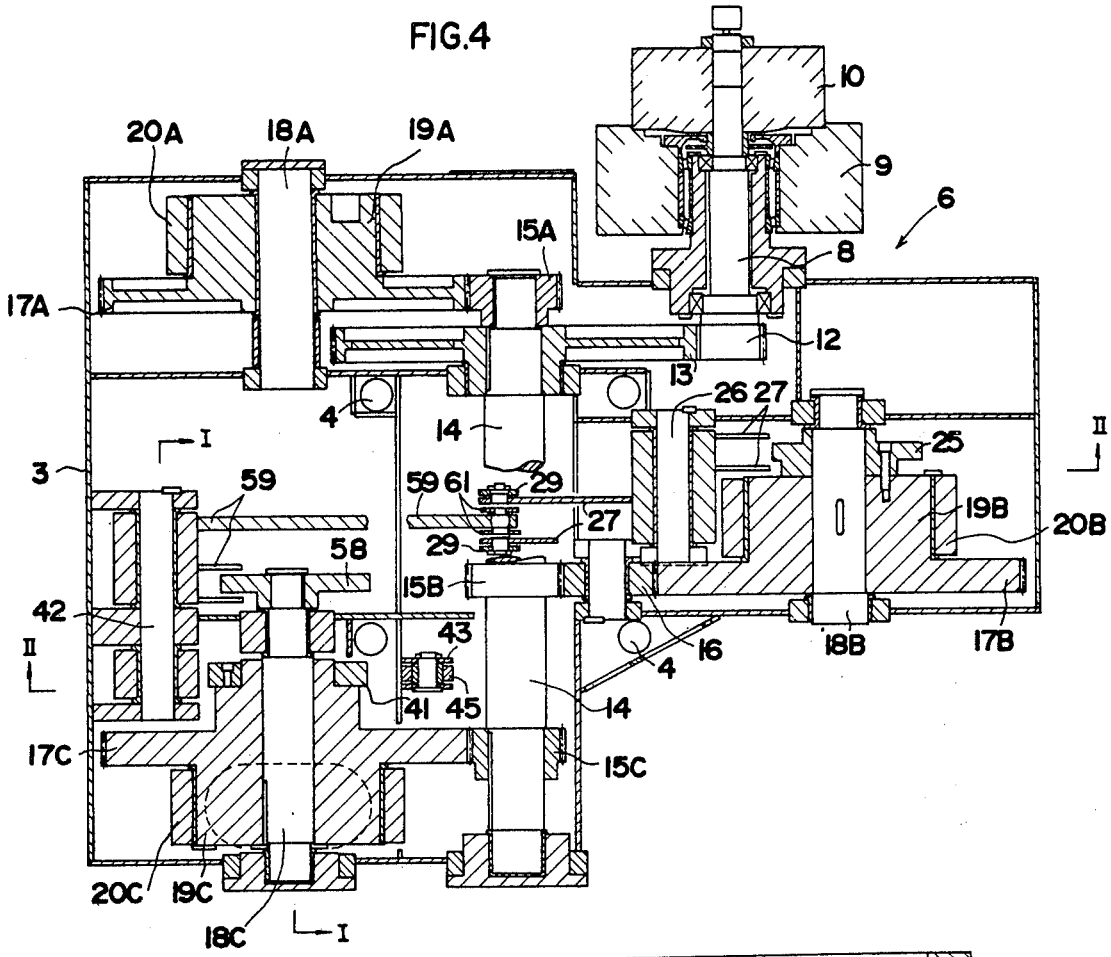
FIG. 4 is a plan view in cross section showing drive means in the interior of a crown.
Figure 5:
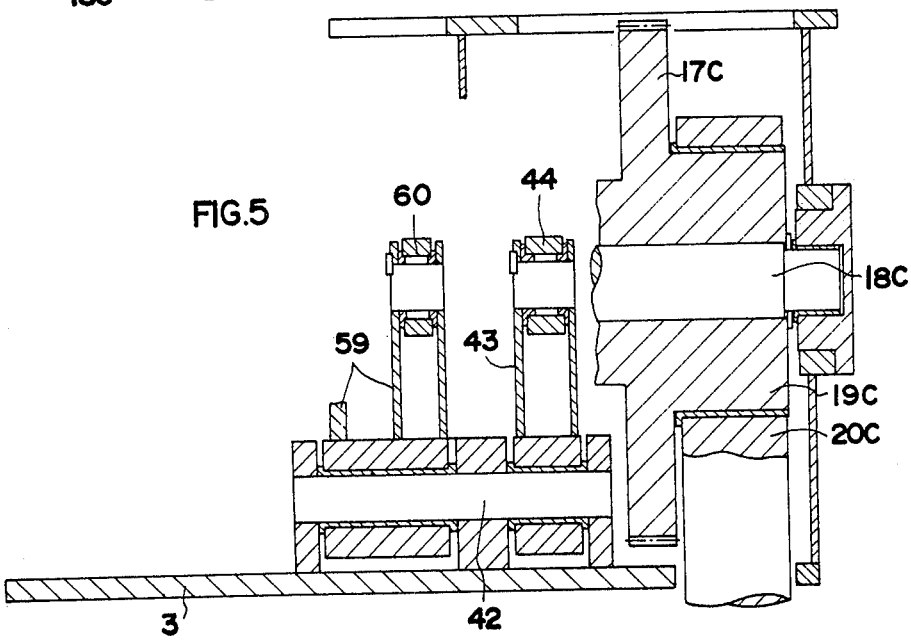
FIG. 5 is a view in section taken along the line I—I in FIG. 4.
Figure 6:
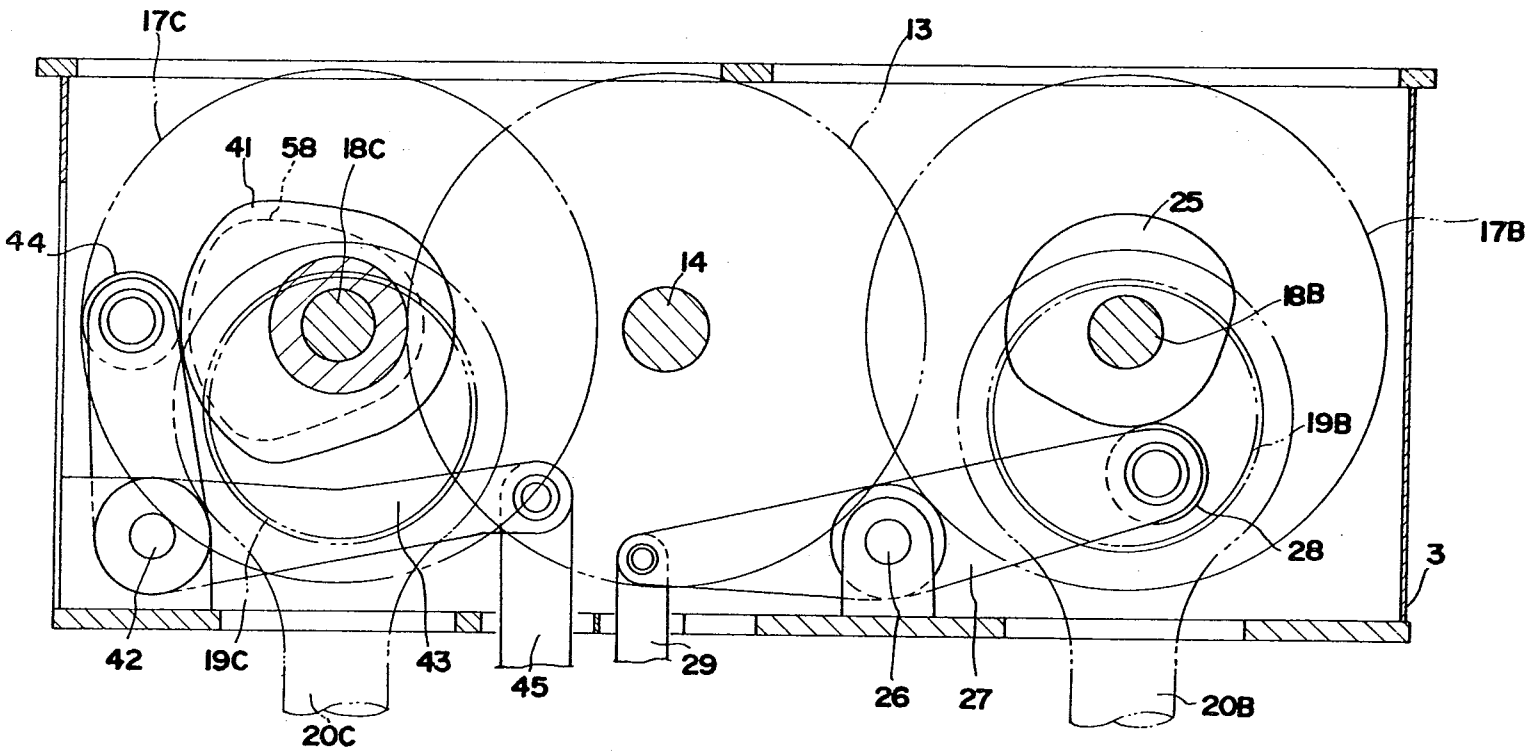
FIG. 6 is a view in section taken along the line II—II in FIG. 4.
Figure 7:
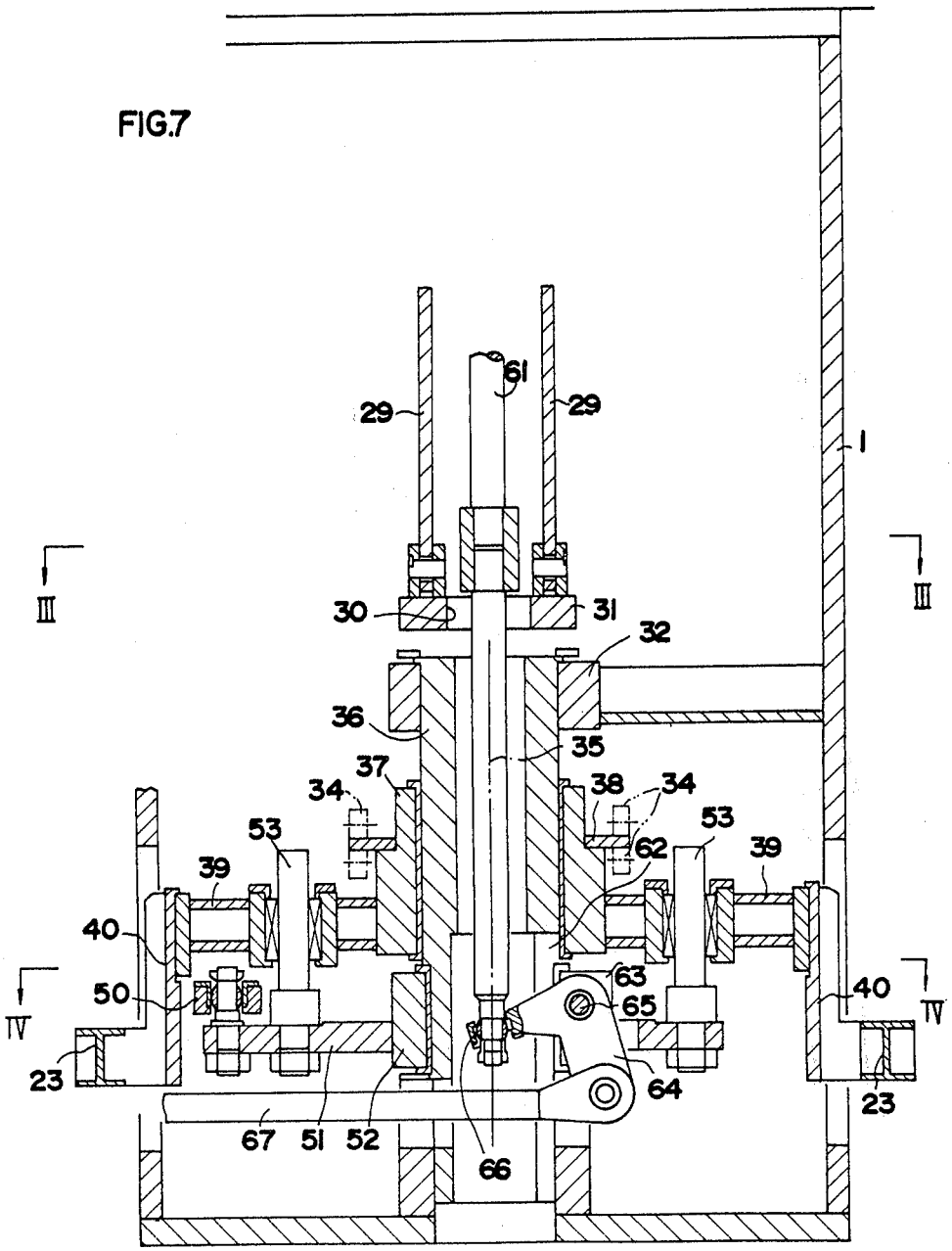
FIG. 7 is a front view in vertical section showing a lower interior portion of an upright.
Figure 8:
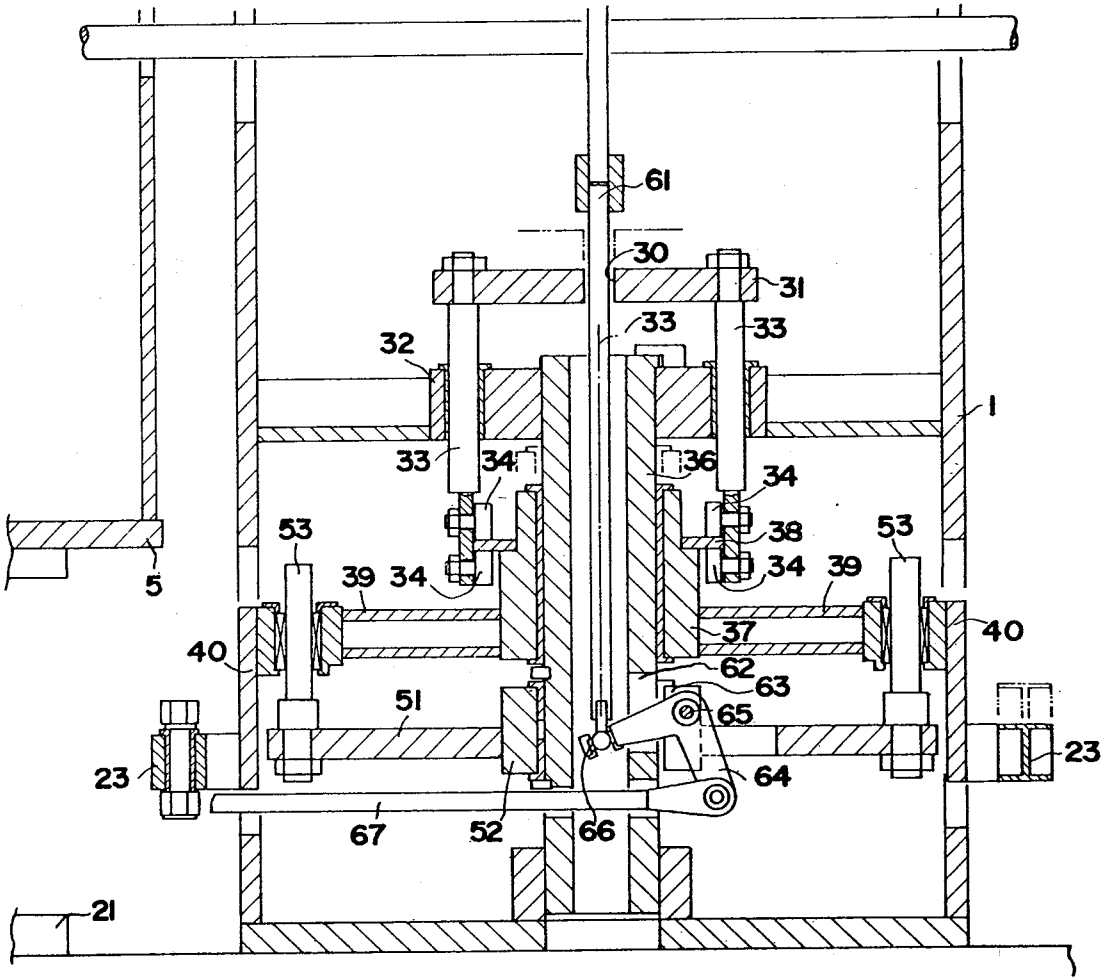
FIG. 8 is a side elevation in vertical section showing the lower interior portion of the upright.

With reference to FIGS. 1 to 12, a hollow cylindrical upright 1 extends upward from the center of a bed 2. A crown 3 is mounted on the top of the upright. Means 4 for fastening the crown 3, the upright 1 and the bed 2 together comprises tie rods extending through these components 3, 1, 2 and nuts. A slide 5 is fitted around the upright 1, movable upward and downward and guided by the upright 1. The slide 5 is in the form of a hollow cylinder in conformity with the external shape of the upright 1.

As seen in FIGS. 1, 2 and 4 to 6, drive means 6 for moving the slide 5 upward and downward comprises a main electric motor 7 disposed at one side of the crown 3, a horizontal power input shaft 8 rotatably mounted on an upper portion of the crown 3, a flywheel 9 attached to the input shaft 8, a wrapping connector 11 for coupling the motor 7 to a clutch-brake unit 10 attached to the input shaft 8, a drive gear 12 mounted on the input shaft 8, a main shaft 14 parallel to the input shaft 8 and provided with a driven gear 13 meshing with the drive gear 12, three main pinions 15A, 15B, 15C mounted on the main shaft 14, three driven gears 17A, 17B, 17C meshing directly with, or coupled by an idler 16 to, the main pinions 15A, 15C, 15C, rotary shafts 18A, 18B, 18C in parallel with the main shaft 14 and supporting thereon the driven gears 17A, 17B, 17C respectively, eccentric rings 19A, 19B, 19C integral with the driven gears 17A, 17B, 17C respectively, and connecting rods 20A, 20B, 20C fitting around the eccentric rings 19A, 19B, 19C respectively. The lower ends of these connecting rods 20A, 20B, 20C are connected to three portions of the slide 5 spaced apart circumferentially thereof.

Indicated at 21 are bolsters having press dies for various pressing steps. The number of the bolsters is varied with the number of pressing steps or the size of the equipment. The present embodiment includes as arranged about the center of the upright at a definite angular spacing of 36 degrees ten stations, namely a workpiece feed station A, working stations B, C, D, E, F, G, H, I and a product delivery station J. The feed and delivery stations A, J may be made serviceable also as working stations. A workpiece feeder 22 is provided outside the feed station A. An annular feed bar 23 provided with pairs of workpiece gripping fingers 24 is movable upward and downward and rotatable in positive and negative directions around the upright 1. Described below are means for driving the feed bar 23 upward and downward, means for driving the same for feeding and clamp drive means for the fingers 24. These means receive power from the foregoing main shaft 14.

The upward and downward driving means (feed bar lifting drive means) will be described first with reference to FIGS. 4 and 6 to 10. A lift cam 25 fitting around the rotary shaft 18B is integral with the eccentric ring 19B. A lift cam lever 27 is pivotably supported at an intermediate portion by a pivot 26 parallel to the shaft 18B. The lift cam lever 27 has at its one end a lift cam follower 28 adapted to contact the lift cam 25. The other end of the cam lever 27 is connected to the upper ends of connecting arms 29 the lower ends of which are attached to a lift plate 31 having a center bore 30. Extending through a support member 32 attached to the upright 1 is a pair of vertically movable rods 33, the upper ends of which are attached to the lift plate 31. The lower end of each rod 33 carries a pair of upper and lower rollers 34. A hollow cylinder 36 is in alignment with the centerline 35 of the press and is supported at its upper end by the support member 32. A movable hollow cylinder 37 vertically movable by being guided by the cylinder 36 is provided with an annular rail 38 which is held between the rollers 34. A pair of turning levers 39 extends outward from the movable cylinder 37. The feed bar 23 is attached to the turning levers 39 by connecting members 40.

Figure 9:
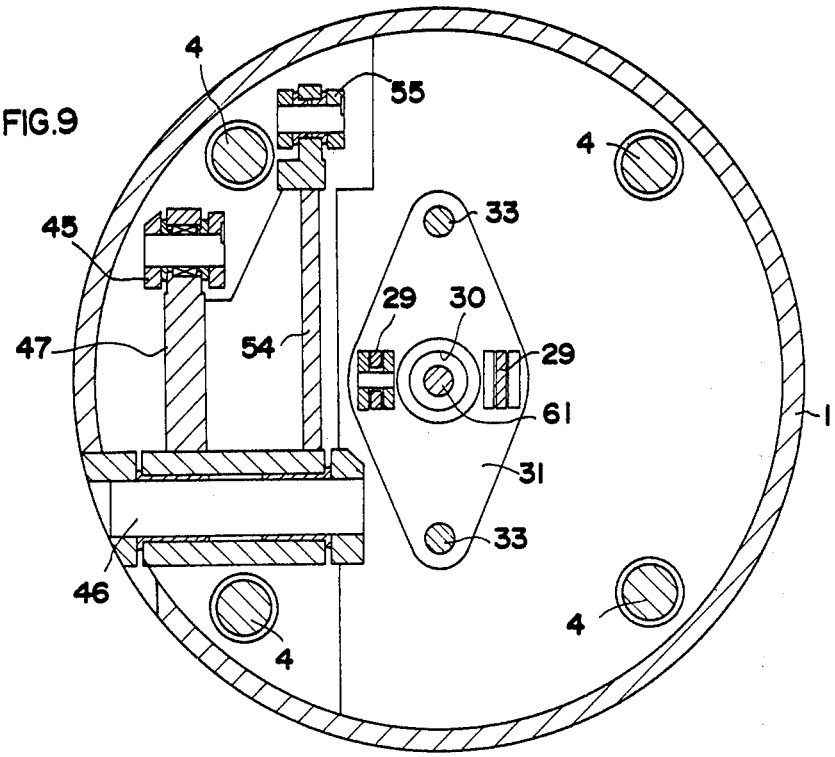
FIG. 9 is a view in section taken along the line III—III in FIG. 7.
Figure 10:
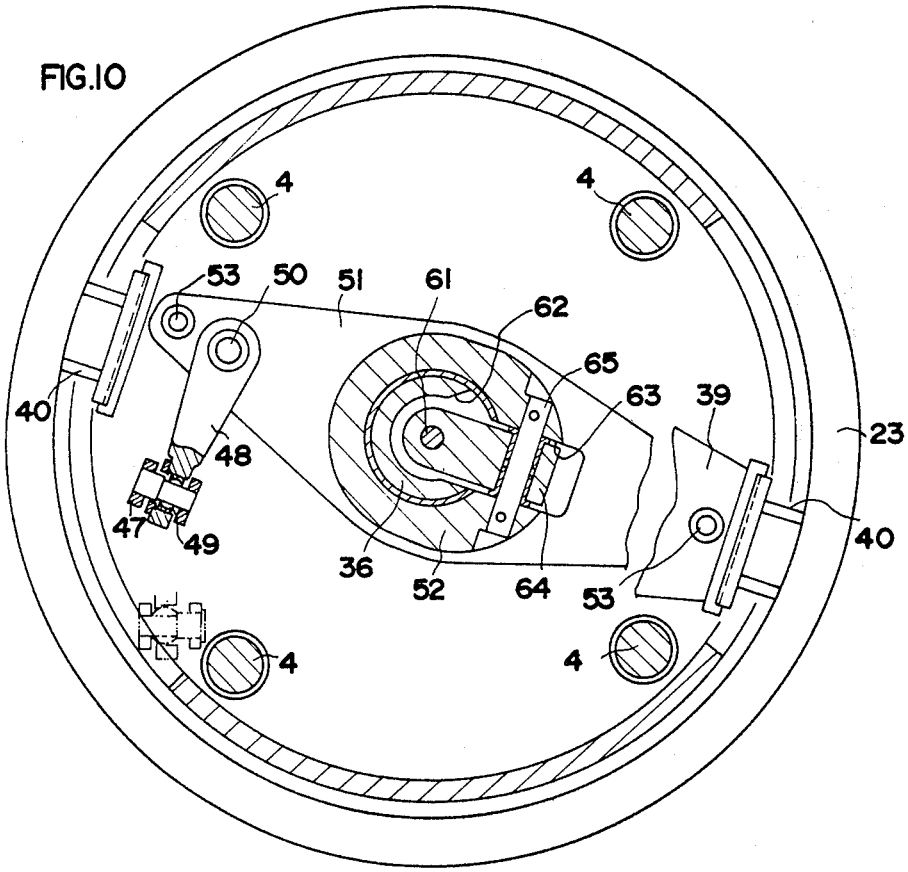
FIG. 10 is a view in section taken along the line IV—IV in FIG. 7.
Figure 11:
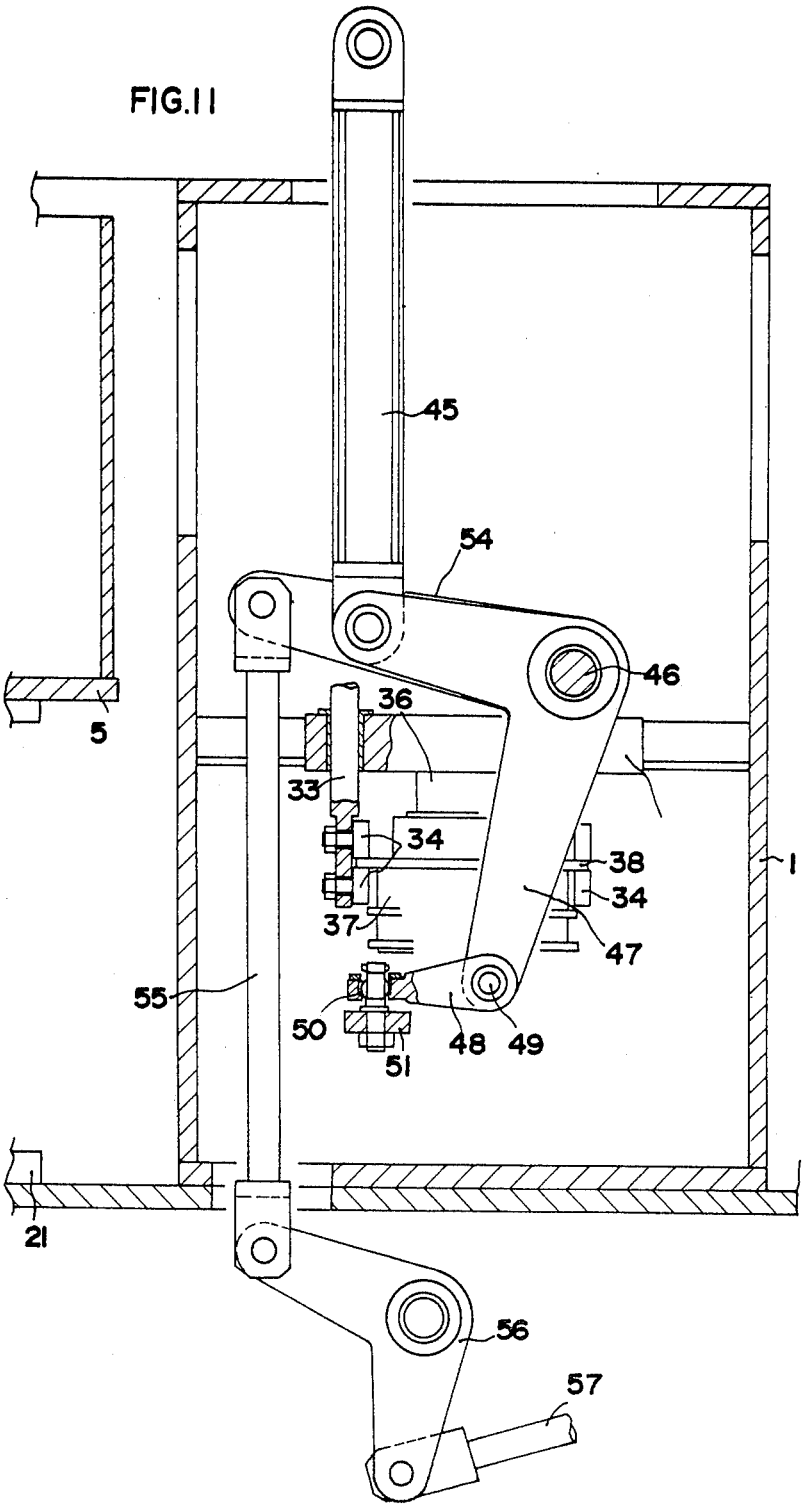
FIG. 11 is a view in vertical section partly broken away and showing the main components of means for driving a feed bar for feeding in the lower interior portion of the upright.

The feeding-driving means for the feed bar will now be described with reference to FIGS. 4 to 12. The rotary shaft 18C is provided with a feed cam 41 integral with the eccentric ring 19C. An L-shaped feed cam lever 43 is pivotably supported at an intermediate portion by a pivot 42 parallel to the rotary shaft 18C. The lever 43 carries at its upper end a cam follower 44 adapted to contact the feed cam 41. A connecting arm 45 connected at its upper end to the lower end of the feed cam lever 43 has a lower end connected to the upper end of an L-shaped link 47 which is pivotably connected at an intermediate portion to a lateral pivot 46 on the upright 1. The lower end of the L-shaped link 47 is connected to a rotary plate 51 by a link 48 and ball joints 49, 50 at the opposite ends of the link 48. Below the movable cylinder 37, a lower movable cylinder 52 is rotatably fitted around the cylinder 36 and has the rotary plate 51 attached thereto. A pair of pins 53 extends upward from the rotary plate 51 symmetrically with respect to the center of its rotation. These pins 53 extend through the turning levers 39 to permit their vertical movement. A link 54 pivotally movable with the L-shaped link 47 is connected by a rod 55 and a link 56 to a restraining cylinder 57 for regulating the amount of movement of the L-shaped link 47 (FIGS. 9 and 11).

Figure 12:
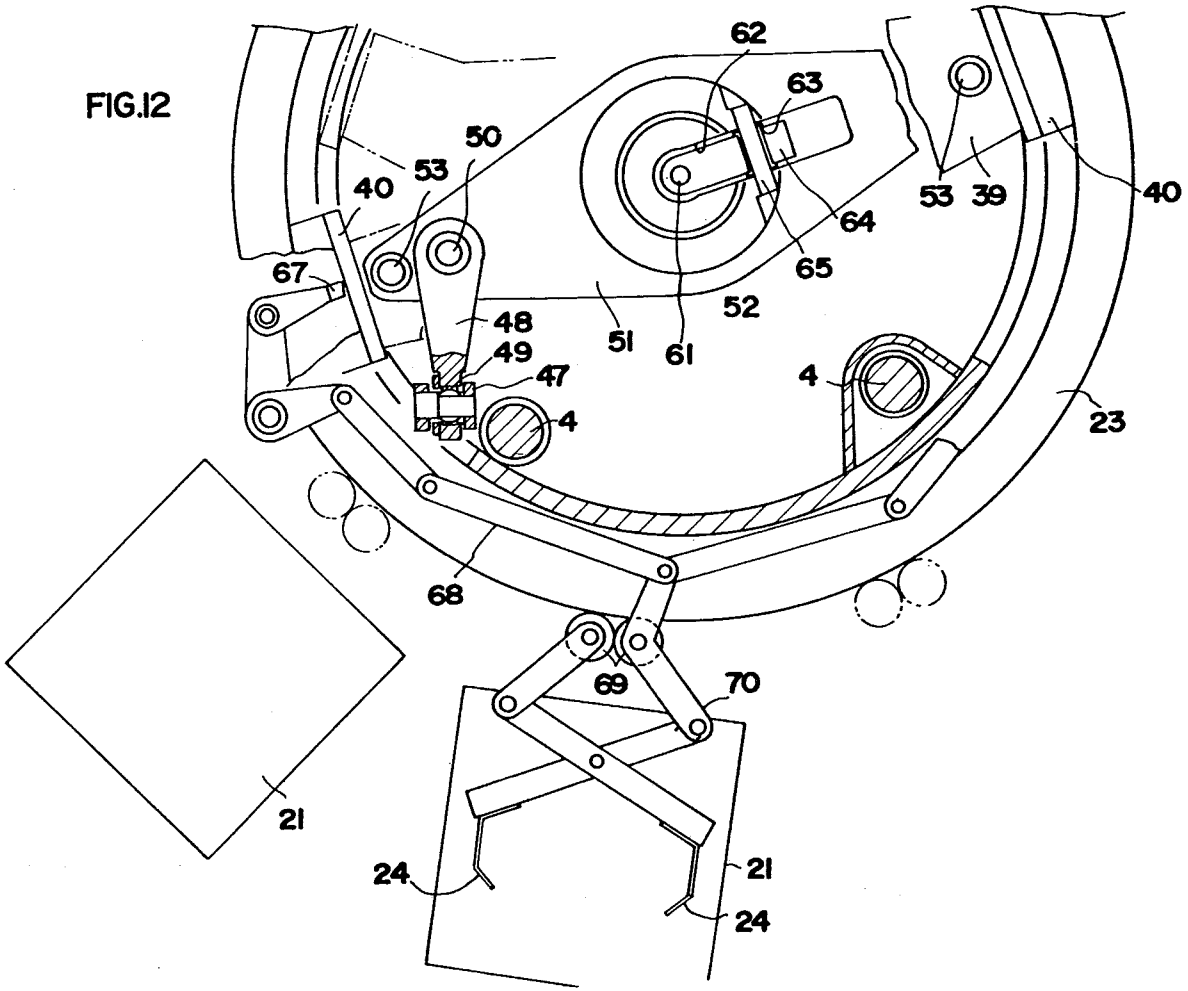
FIG. 12 is a fragmentary plan view in cross section showing clamp drive means.
Figure 13:
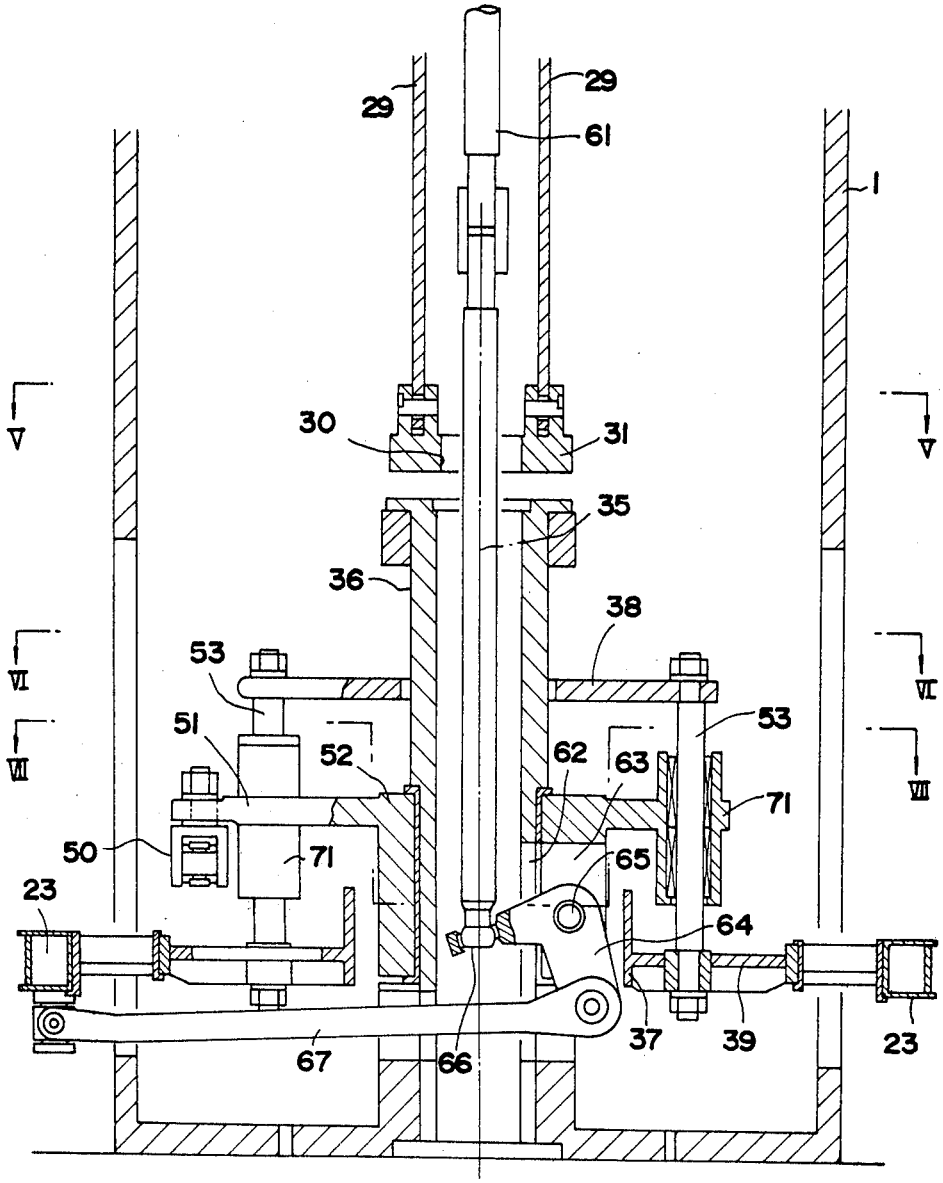
FIG. 13 is a front view in vertical section showing modified feed bar lifting drive means and modified means for driving the feed bar for feeding.
Figure 14:
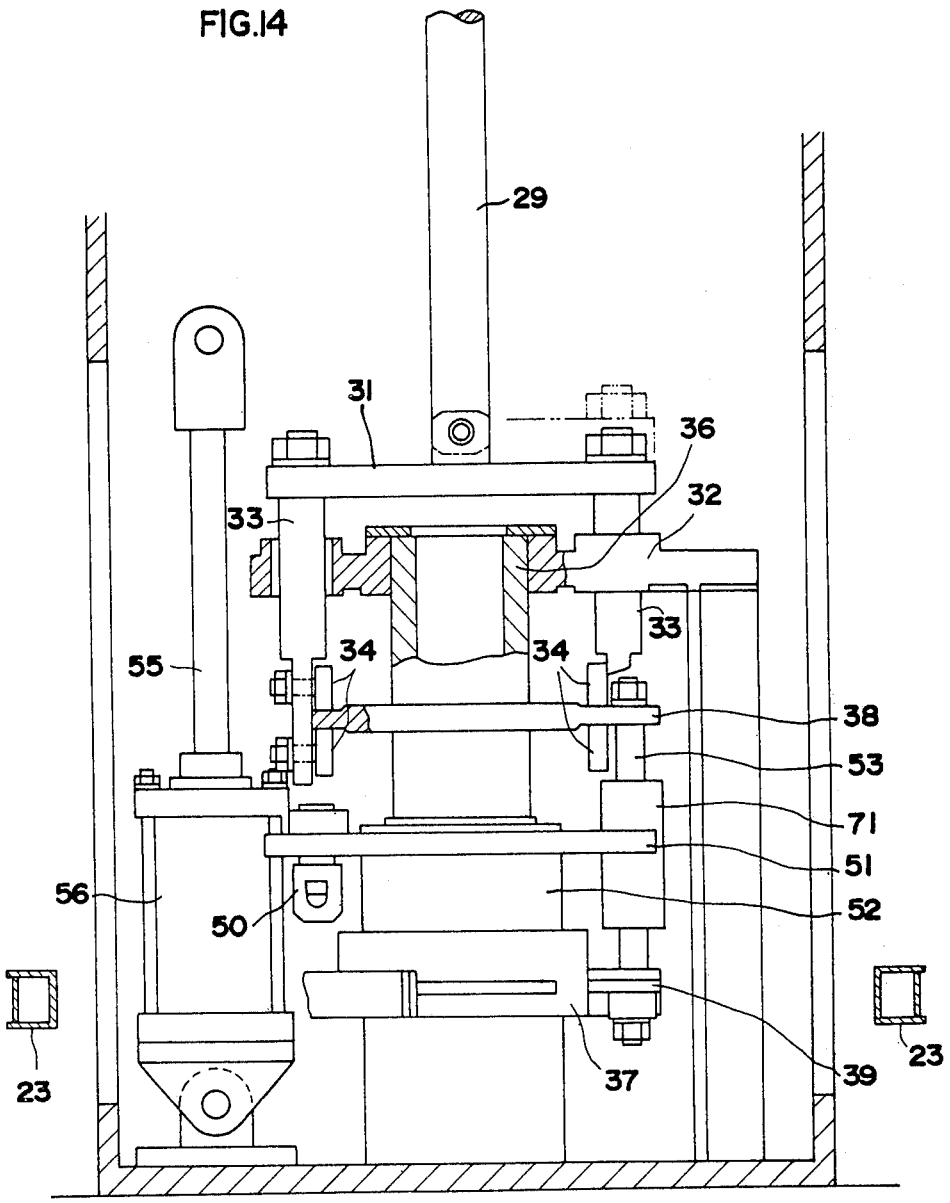
FIG. 14 is a side elevation in vertical section showing the same.
Figure 15:
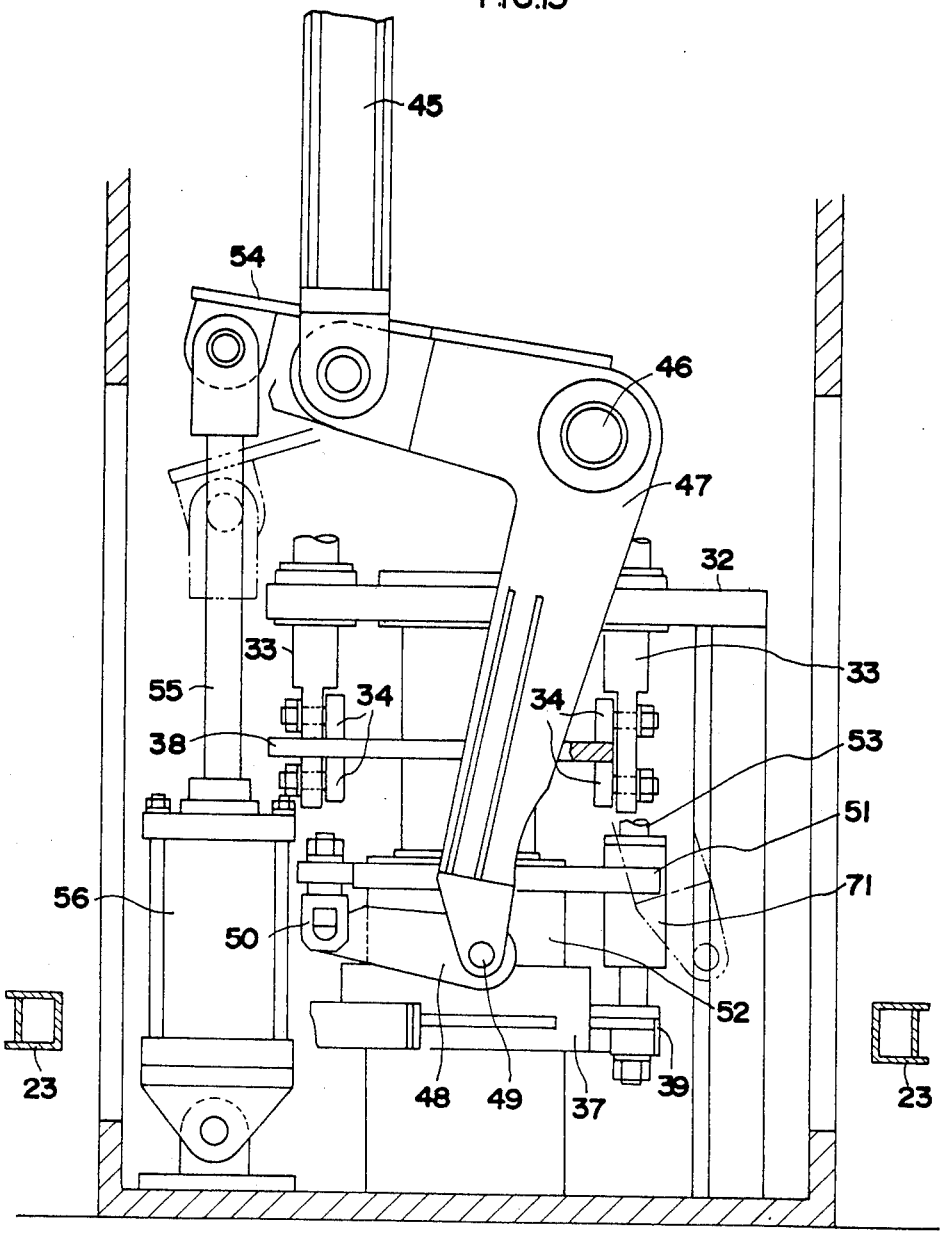
FIG. 15 is a side elevation in vertical section showing the main components of the modified feed bar feeding-driving means as the means is seen from a different position from FIG. 14.
Figure 16:
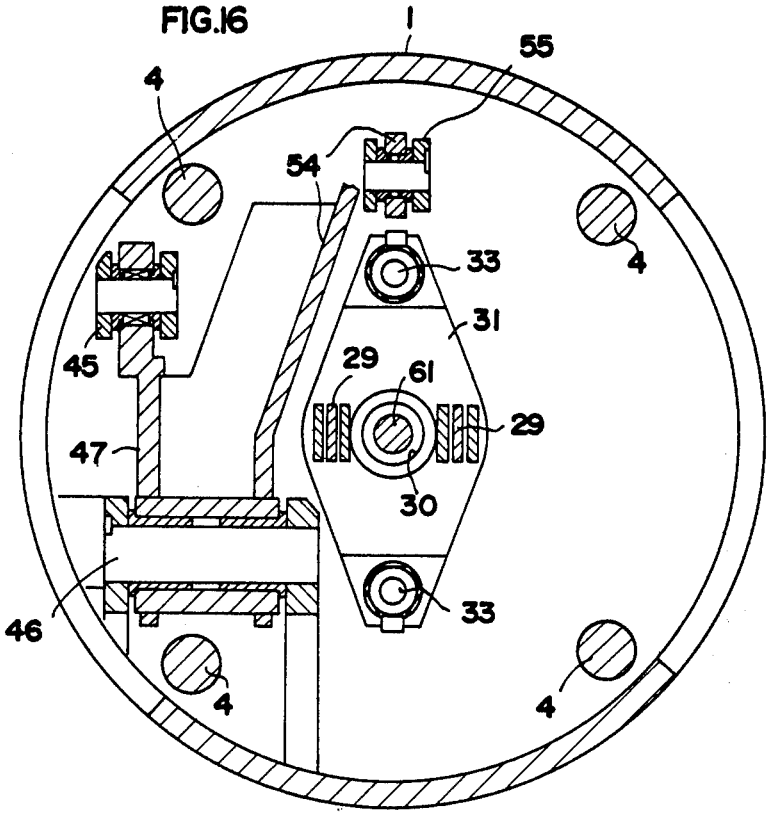
FIG. 16 is a view in section taken along the line V—V in FIG. 13.
Figure 17:
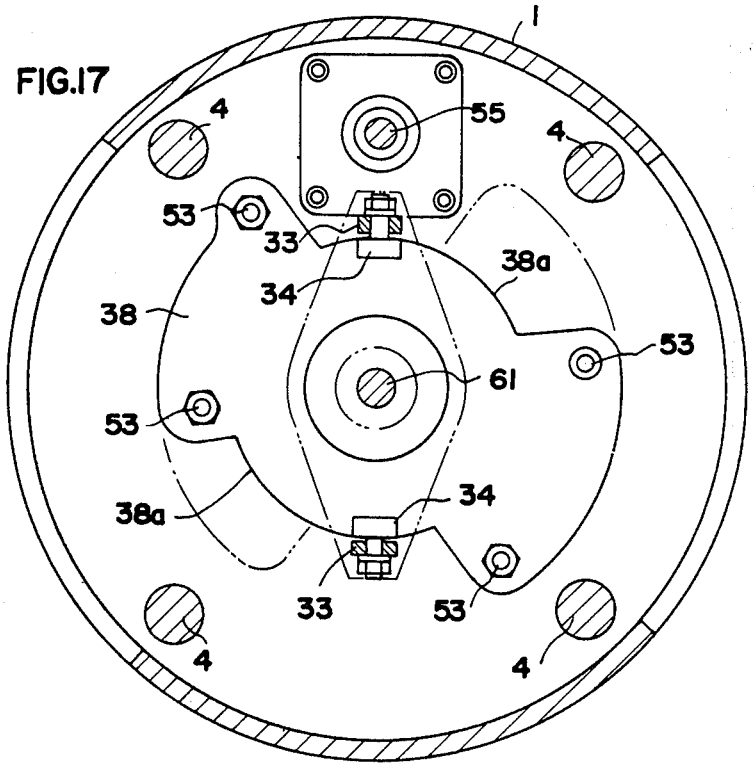
FIG. 17 is a view in section taken along the line VI—VI in FIG. 13.
Figure 18:
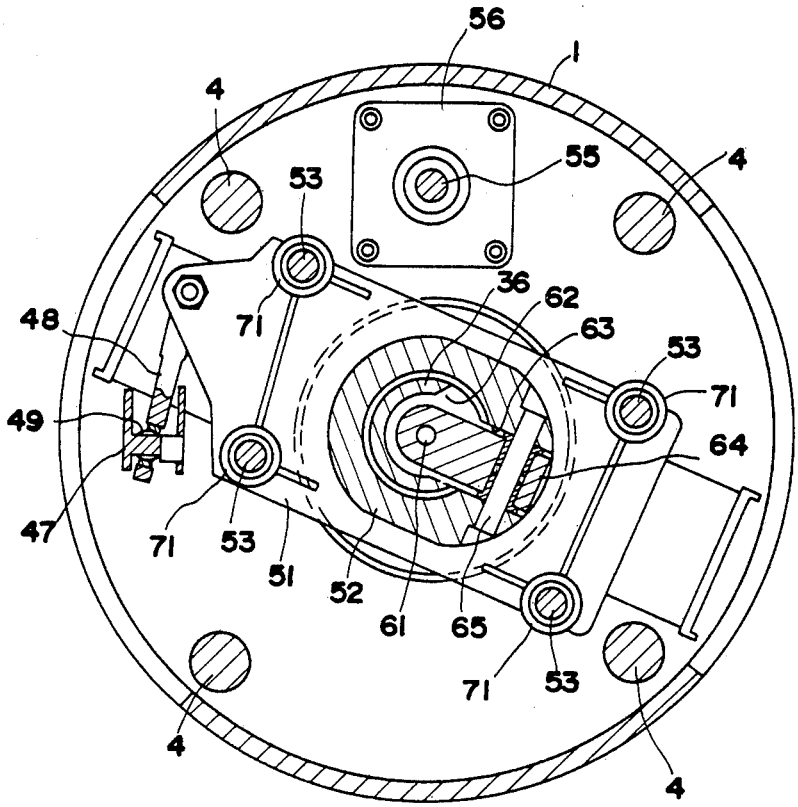
FIG. 18 is a view in section taken along the line VII—VII in FIG. 13.

The clamp drive means for the fingers 24 will be described with reference to FIGS. 4 to 12. The rotary shaft 18C has a clamp cam 58 which is rotatable therewith. An L-shaped clamp cam lever 59 is pivotably mounted at an intermediate portion on the pivot 42. Supported on the upper end of the clamp cam lever 59 is a clamp cam follower 60 which is adapted to contact the clamp cam 58. The lever 59 has a lower end positioned on the centerline 35 of the press and connected to the upper end of a clamp connecting rod 61. The rod 61 extends through the bore 30 and is positioned within the cylinder 36. The cylinder 36 and the lower movable cylinder 52 have cutouts 62, 63 respectively. An L-shaped lever 64 extends through the cutouts 62, 63 and is pivotably supported at an intermediate portion thereof by a lateral pivot 65 on the lower movable cylinder 52. The lever 64 has one end connected by a universal joint 66 to the lower end of the clamp connecting rod 61 and the other end connected to a clamp arm 67. The clamp arm 67 extends laterally outward from the upright 1. As seen in FIG. 12, the forward end of the arm 67 is connected by an L-shaped lever to interconnected bars 68 arranged along the feed bar 23, whereby the push-pull movement of the clamp arm 67 is converted to circumferential movement of the interconnected bars 68. By means of a pair of gears 69, the circumferential movement causes a pantograph 70 to open or close. A pair of fingers 24 is attached to the forward end of the pantograph.

Press work is performed in the following manner. While the slide 5 is moving upward, a workpiece is fed by a feeder 22 to the station A, while a finished product is delivered from the station J. With the descent of the slide 5, workpieces are pressed at the stations A to J or at the stations B to I. During the subsequent ascent of the slide 5, the workpiece in each of the stations is held by each pair of fingers 24 on the ascending feed bar 23, then transferred to the location of the next station by the forward rotation of the feed bar 23 through the specified angle (36 degrees) and thereafter delivered to the station with the descent of the feed bar 23. At this time, a workpiece is fed and the finished product is delivered again as described above. When the slide subsequently descends, the workpiece in each station is pressed. At this time, the feed bar 23 returns through the specified angle (36 degrees) to return the fingers 24 to the original position.

The slide 5 is moved vertically in the following manner. The rotation of the main motor 7 is delivered to the power input shaft 8 to rotate the main shaft 14 at a reduced speed through the drive gear 12 and the driven gear 13. Through the main pinions 15A, 15B, 15C and the driven gears 17A, 17B, 17C, the rotation of the main shaft 14 is delivered to the eccentric rings 19A, 19B, 19C, which in turn move the connecting rods 20A, 20B, 20C, connected to the slide 5, upward or downward.

The feed bar 23 is moved upward or downward in the following manner. The rotation of the lift cam 25 integral with the eccentric ring 19B is converted by the lift cam follower 28 and the lift cam lever 27 to an upward or downward movement of the lift connecting arms 29. The lift plate 31 moves upward or downward with the arms 29, further similarly moving the rollers 34 through the rods 33. The rail 38, which is held between the rollers 34 and integral with the movable cylinder 37, moves the cylinder 37 upward or downward around the cylinder 36. The movement of the cylinder 37 is transmitted through the turning levers 39 and the connecting members 40 to the feed bar 23, so that the bar 23 is moved upward or downward by a specified amount.

The feed bar 23 will be rotated in the following manner. The rotation of the feed cam 41 integral with the eccentric ring 19C is converted by the feed cam follower 44 and the feed cam lever 43 to an upward or downward movement of the connecting arm 45 for feeding. The movement of the arm 45 is converted by the L-shaped link 47 and the link 48 to positive or reverse rotation of the rotary plate 51. The rotation of the rotary plate 51 is delivered by the pin 53 to the turning levers 39, whereby the feed bar 23 is rotated forward or backward by a specified amount.

The fingers 24 are operated for clamping in the following manner. The rotation of the clamp cam 58 rotatable with the rotary shaft 18C is converted by the clamp cam follower 60 and the clamp cam lever 59 to an upward or downward movement of the clamp connecting rod 61, which in turn pushes or pulls the clamp arms 67 through the L-shaped lever 64. Through the interconnected bars 68, the movement of the arm 67 rotates the gears 69 in directions opposite to each other, whereby the fingers 24 are opened or closed through the action of pantographs 70.

The lifting drive means permits the rotation of the feed bar 23, i.e, the turn of the turning levers 39, by the arrangement in which the rail 38 is held between the rollers 34, while the feeding-driving means permits the vertical movement of the feed bar 23 by the pins 53 which slidably extend through the levers 39. The clamp drive means permits the rotation of the feed bar 23 by the arrangement in which the L-shaped lever 64 is attached to the lower movable cylinder 52 and connected to the clamp connecting rod 61 by the universal joint 66.

Figure 19:
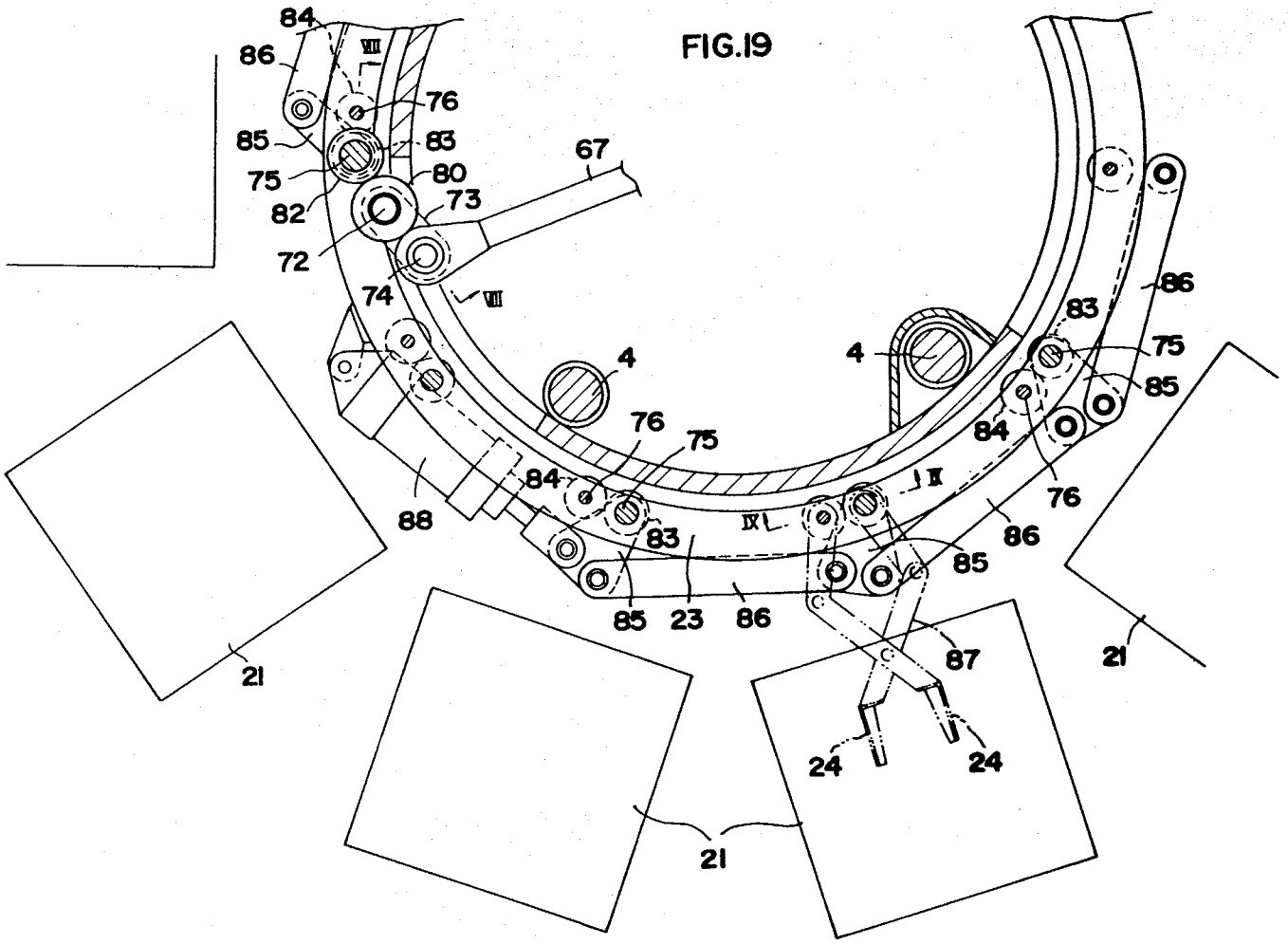
FIG. 19 is a fragmentary plan view in cross section partly broken away and showing modified clamp drive means.
Figure 20:
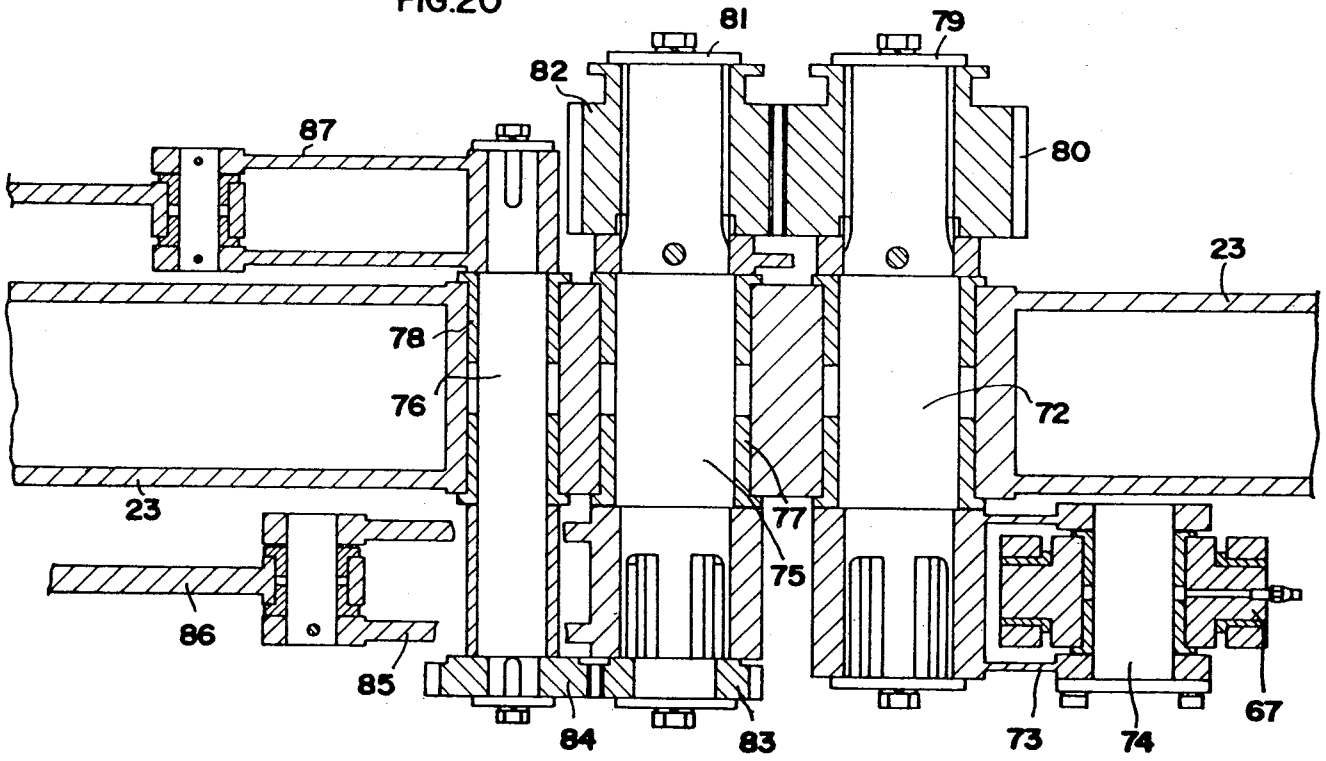
FIG. 20 is a view in section taken along the line VIII—VIII in FIG. 19.
Figure 21:
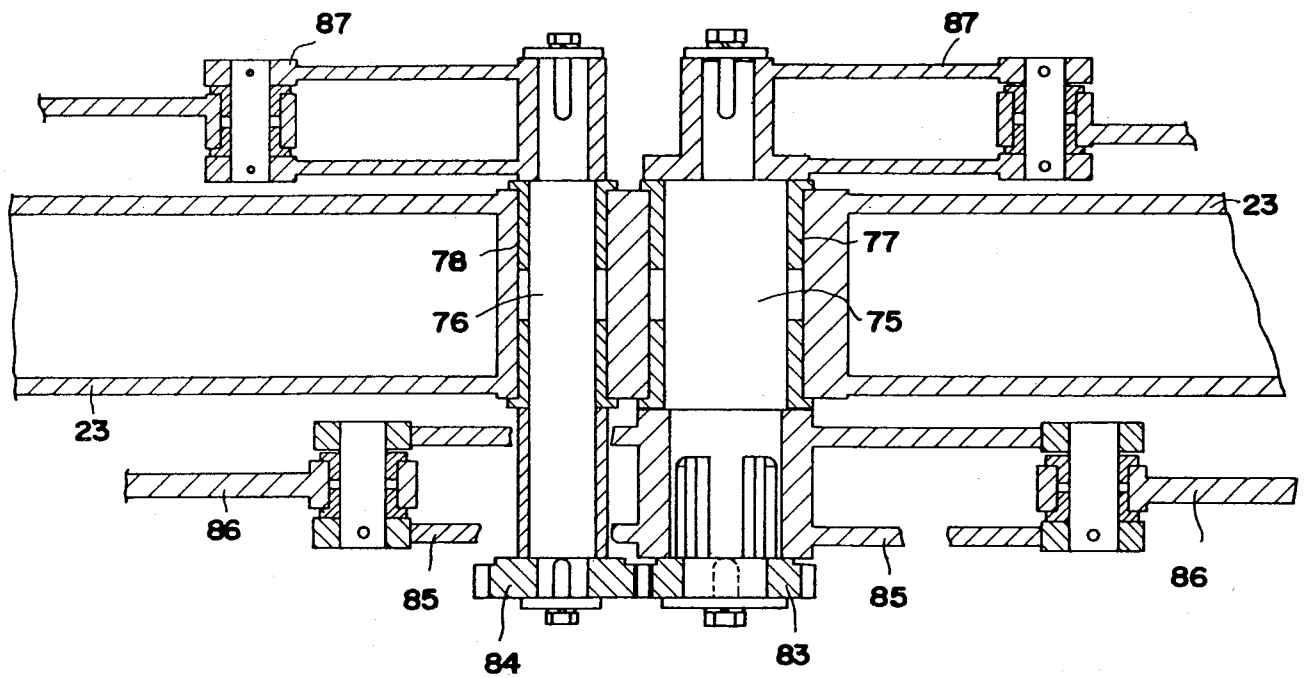
FIG. 21 is a view in section taken along the line IX—IX in FIG. 19.

Modifications of the lifting device means and the feeding-driving means for the feed bar will be described below with reference to FIGS. 13 to 18, and a modification of the clamp drive means for the fingers with reference to FIGS. 19 to 21. The overall construction other than these modifications is similar to the one already described and therefore will not be described below.

The modified lifting drive means for the feed bar has the same construction as the one already described in respect of the drive source in the crown 3 through the the lift plate 31. A pair of vertically movable rods 33 extending through a support member 32 attached to the upright 1 are provided symmetrically with respect to the center axis 35 of the press. Each of the rods 33 has an upper end attached to the lift plate 31 and a lower end carrying a pair of upper and lower rollers 34. An upright hollow cylinder 16 is in alignment with the centerline 35 of the press and gas an upper end supported by the support member 32. A rail plate 18 is rotatable and upwardly or downwardly movable by being guided by the cylinder 36. The rail plate 38 is held between the rollers 34. As will be apparent from FIG. 17, the rail plate 38 has circular edges 38*a* centered about the centerline 35 of the press over specified angular ranges symmetrically with respect to the centerline 35. The rollers 34 hold the circular edges 38*a* from above and below, whereby the rail plate 38 is made rotatable through the angular range. A plurality of pins 53 are fastened at their upper ends to the plate 38. The downwardly extending lower ends of the pins 53 are fastened to a horizontal flange 39 of a movable hollow cylinder 37 which is vertically movable and rotatable around the cylinder 36. The feed bar 23 is attached to the horizontal flange 39.

The modified feeding-driving means has the same construction as the one already described in respect of the drive source in the crown 3 through the L-shaped link 47. The lower end of the L-shaped link 47 is connected by a link 48 and a ball joint 49 to a universal joint 50 attached to a rotary plate 51. The rotary plate 51 is disposed below the rail plate 38 and connected at its center portion to a lower movable cylinder 52 which is supported by and only rotatable around the cylinder 36. The rotary plate 51 has pin guides 71 having the pins 53 inserted therethrough for guiding. The pins 53 are movable upward and downward through the guides 71. A line 54 pivotally movable with the L-shaped link 47 is connected by a rod 55 to a restraining cylinder 56.

The modified clamp drive means for the fingers 24 is the same as the one already described with respect to the drive source in the crown 3 through the clamp arm 67. A clamp pin 72 is rotatably mounted on the feed bar 23. A pivotal link 73 fixed at its base end to the clamp pin 72 has a forward end which is connected by a vertical pin 74 to the forward end of the clamp arm 67. Accordingly the clamp pin 72 is rotatable in a positive or reverse direction by the forward or backward movement of the clamp arm 67. Beside the clamp pin 72, a first finger pivot 75 and a second finger pivot 76 are arranged side by side. The finger pivots 75, 76 are rotatably supported by bearings 77, 78 on the feed bar 23. A replaceable drive gear 80 is attached to the upper end of the clamp pin 72 by a fixing member 79. A replaceable driven gear 82 is attached to the upper end of the first finger pivot 75 by a fixing member 81. The drive gear 80 and the driven gear 82 are in mesh with each other, whereby the first finger pivot 75 is coupled to the clamp pin 72. A gear 83 is fixed to the lower end of the first finger pivot 75, and a gear 84 to the lower end of the second finger pivot 76. These gears 83, 84 are in mesh with each other, whereby the pivots 75, 76 are made rotatable in opposite directions to each other in operative relation. The pivots 75, 76 having the gears 83, 84 provide a pair, and a plurality of such pairs are mounted on the feed bar 23 in corresponding relation to the stations A to J individually. An arm 85 extends from the lower portion of each of the first finger pivots 75. The arms 85 are connected to one another by interconnecting bars 86, so that the pair which is movable by the clamp arm 67 moves simultaneously with all the other pairs. At this time, the interconnecting bars 86 perform a circular motion in a positive or negative direction. Each pair of pivots 75, 76 is provided with a pantograph 87 which has the fingers 24 at its outer end. Indicated at 88 is a restraining cylinder.

The foregoing modified lifting drive means and feeding-driving means operate substantially in the same manner as those shown in FIGS. 1 to 12, so that the operation of the modified clamp drive means only will be described below briefly.

The forward or reverse movement of the clamp arm 67 delivered from the crown 3 rotates the clamp pin 72 positively or reversely through the pivotal link 73, further similarly rotating the first finger pivot 75 through the drive gear 80 and the driven gear 82. The rotation of the first finger pivot 75 is delivered through the gears 83, 84 to the second finger pivot 76 to rotate the pivot 76 in a direction opposite to the direction of rotation of the first finger pivot 75. The rotation of the pivots 75, 76 in directions opposite to each other operates the pantograph 87 and opens or closes the fingers 24 connected thereto. The rotation of the first pivot 75 coupled to the clamp pin 72 is delivered to the other first finger pivots 75 through the interconnecting bars 86, with the result that the other fingers 24 are also opened or closed by the other pairs at the same time. The amount of clamping movement by the fingers 24 is adjustable by replacing the drive and driven gears 80, 82 and thereby changing the gear ratio.

The present invention is not limited to the above embodiments described with reference to the accompanying drawings, but various modifications can be made within the scope defined by the appended claims.

What is claimed is:

1. A rotary transfer press comprising a bed; an upright extending upward from the bed, a crown mounted on the upright and providing a plurality of stations between the crown and the bed in an annular arrangement; a slide upwardly and downwardly movably guided on said upright; a feed bar having clamping means corresponding in number to the number of the stations and provided around the upright for transferring workpieces from station to station in succession; slide drive means disposed in the crown and connected to said slide for moving the slide upward and downward and comprising a main shaft coupled to a main electric motor to rotate at a reduced speed, a plurality of eccentric rings coupled to the main shaft to rotate at a reduced speed and connecting rods connecting the eccentric rings to the slide; feed bar lifting drive means having a lift cam coupled to the slide drive means and actuated by the lift cam for moving the feed bar upward and downward; feed bar feeding-driving means having a feed cam coupled to the slide drive means and actuated by the feed cam; and clamp drive means having a clamp cam coupled to the slide drive means and actuated by the clamp cam for operating the clamping means.

2. A rotary transfer press as defined in claim 1 wherein the lift cam, the feed cam and the clamp cam are coupled to selected ones of said plurality of eccentric rings.

3. A rotary transfer press as defined in claim 1 or 2 wherein the feed bar lifting drive means includes a lift cam lever pivotally movable by the rotation of the lift cam, a lift connecting arm connected to the lift cam lever for converting the pivotal movement of the lift cam lever to an upward or downward movement and means for transmitting the upward or downward movement of the lift connecting arm to the feed bar; the feed bar feeding-driving means includes a feed cam lever pivotally movable by the rotation of the feed cam, a feed connecting arm connected to the feed cam lever for converting the pivotal movement of the feed cam lever to an upward or downward movement, and means connecting said feed connecting arm and said feed bar for transmitting the upward or downward movement of the feed connecting arm to the feed bar; and the clamp drive means includes a clamp cam lever pivotally movable by the rotation of the clamp cam, a clamp connecting rod for converting the pivotal movement of the clamp cam lever to an upward or downward movement and means connecting said clamp connecting rod and said clamping means for converting the upward or downward movement of the clamp connecting rod to open or close the clamping means.

4. A rotary transfer press as defined in claim 3 wherein the transmitting means of the feed bar lifting drive means comprises a lift plate connected to the lift connecting arm, a pair of upper and lower rollers mounted on each of rods extending from the lift plate, a movable cylinder integrally provided with a rail rotatably held between the rollers around the center of the press and turning levers extending integrally from the movable cylinder and connected to the feed bar by connecting members; and the transmitting means of the feed bar feeding-driving means comprises an L-shaped lever pivotally movable by the upward or downward movement of the feed connecting arm, a rotary plate connected to the L-shaped lever by universal joint means and rotatable by the pivotal movement of the L-shaped lever through a specified angle about the center of the press and pins extending from the rotary plate and inserted slidably through the turning levers.

5. A rotary transfer press as defined in claim 3 wherein the transmitting means of the feed bar lifting drive means comprises a lift plate connected to the lift connecting arm, a pair of upper and lower rollers mounted on each of rods extending from the lift plate, a rail plate held between the rollers and rotatable through a specified angle about the center of the press and a movable cylinder connected to pins fastened to the rail plate and further connected to the feed bar; and the transmitting means of the feed bar feeding-driving means comprises an L-shaped lever pivotally movable by the upward or downward movement of the feed connecting arm, a rotary plate connected to the L-shaped lever by universal joint means and rotatable by the pivotal movement of the L-shaped lever through a specified angle about the center of the press and pin guides attached to the rotary plate and having the pins slidably inserted therethrough for guiding.

6. A rotary transfer press as defined in claim 3 wherein the transmitting means of the clamp drive means comprises an L-shaped lever pivotally movable by the clamp connecting rod, a clamp arm for delivering the pivotal movement of the L-shaped lever outward from the upright as a horizontal push-pull movement, interconnected bars provided along the feed bar and circumferentially movable by the push-pull movement received from the clamp arm through an L-shaped lever, and finger opening and closing means disposed in corresponding relation to each of the stations and having a pair of fingers serviceable as the clamping means, the fingers being openable and closable by the circumferential movement of the interconnected bars and by the action of a pair of meshing gears.

7. A rotary transfer press as defined in claim 3 wherein the transmitting means of the clamp drive means comprises an L-shaped lever pivotally movable by the clamp connecting rod, a clamp arm for delivering the pivotal movement of the L-shaped lever outward from the upright as a horizontal push-pull movement, a clamp pin mounted on the feed bar for receiving the push-pull movement from the clamp arm through a pivotal link as positive or reverse rotation, pairs of finger pivots mounted on the feed bar and positioned in corresponding relation to the stations individually, the finger pivots in each pair being coupled together by a pair of gears, one of the pairs of finger pivots being coupled to the clamp pin by a train of gears, means for interconnecting the finger pivots of the pairs to couple the pairs together, and finger opening and closing means attached to the finger pivots of each pair and having a pair of fingers serviceable as the clamping means, the fingers being openable and closable by the rotation of the finger pivots.

* * * * *

UNITED STATES PATENT AND TRADEMARK OFFICE

CERTIFICATE OF CORRECTION

PATENT NO. : 4,413,498

DATED : November 8, 1983

INVENTOR(S) : HIROSHI IMAOKA ET AL

It is certified that error appears in the above—identified patent and that said Letters Patent is hereby corrected as shown below:

Column 3, line 12 "15C" (first occurrance) should read --15B--

Column 5, line 57 "device" should read --drive--

Column 6, line 5, "16" should read --36--

Column 6, line 6, "gas" should read --has--

Column 6, line 7, "18" should read --38--

Column 6, line 35 "line" should read --link--

Signed and Sealed this

*Twelfth* Day of *June 1984*

[SEAL]

*Attest:*

GERALD J. MOSSINGHOFF

*Attesting Officer*

*Commissioner of Patents and Trademarks*